US006076223A

United States Patent [19]

Dair et al.

[11] Patent Number: 6,076,223

[45] **Date of Patent: *Jun. 20, 2000**

[54] TOOTHBRUSH

[75] Inventors: Thomas M. Dair, Valley Cottage, N.Y.; Daniel J. Formosa, Montvale, N.J.

[73] Assignee: Johnson & Johnson Consumer Companies, Inc., Skillman, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/183,561

[22] Filed: Oct. 30, 1998

Related U.S. Application Data

[63] Continuation of application No. 09/089,000, Jun. 2, 1998, abandoned, which is a continuation of application No. 08/936,851, Sep. 24, 1997, abandoned, which is a continuation of application No. 08/713,907, Sep. 13, 1996, abandoned, which is a continuation of application No. 08/497,682, Jun. 30, 1995, abandoned, which is a continuation of application No. 08/322,836, Oct. 13, 1994, abandoned, which is a continuation of application No. 08/164,653, Dec. 9, 1993, abandoned, which is a continuation of application No. 08/017,523, Feb. 16, 1993, abandoned.

[51] Int. Cl.[7] ..... A46B 9/04; A46B 5/00

[52] U.S. Cl. ..... 15/167.1; 15/143.1; 248/683; 248/688; D4/104; D4/112

[58] Field of Search ..... 15/143.1, 167.1, 15/167.2; 248/110, 682, 683, 688; D4/104, 112, 138

[56] References Cited

U.S. PATENT DOCUMENTS

| | | | |
|---|---|---|---|
| D. 59,127 | 9/1921 | Perrault | D4/104 |
| 1,659,622 | 2/1928 | Atamian | 15/143.1 |
| 1,690,311 | 11/1928 | Reich | 248/688 |
| 1,813,361 | 7/1931 | Priest | 15/167.1 |
| 1,899,242 | 2/1933 | McNab | 15/143.1 |
| 2,416,684 | 3/1947 | Fischer | 15/167.1 |
| 4,033,007 | 7/1977 | Hadary | 15/143.1 |
| 4,306,327 | 12/1981 | Zeski | 15/167.1 |
| 4,621,387 | 11/1986 | Noser | 15/143.1 |
| 4,667,360 | 5/1987 | Marthaler et al. | 15/167.1 |
| 4,672,706 | 6/1987 | Hill | 15/167.1 |
| 5,052,071 | 10/1991 | Halm | 15/167.1 |
| 5,306,151 | 4/1994 | Rauch | 15/143.1 |

FOREIGN PATENT DOCUMENTS

| | | | |
|---|---|---|---|
| 183428 | 12/1936 | Switzerland | 15/143.1 |
| 190029 | 6/1937 | Switzerland | 15/143.1 |
| 15598 | 5/1904 | United Kingdom | 15/143.1 |
| 84-01700 | 5/1984 | WIPO | 15/143.1 |

*Primary Examiner*—Mark Spisich

[57] ABSTRACT

A self-standing toothbrush having a cup-shaped member disposed of on its base is disclosed. The cup-shaped member substantially enhances the stability of the toothbrush when it is disposed in an upright position relative to a support surface.

11 Claims, 2 Drawing Sheets

TOOTHBRUSH

CROSS-REFERENCE TO RELATED APPLICATIONS

The present application is a continuation of U.S. application Ser. No. 09/089,000, filed Jun. 2, 1998 (now abandoned), which is a continuation of U.S. application Ser. No. 08/936,851, filed Sep. 24, 1997 (now abandoned), which is continuation of U.S. application Ser. No. 08/713,907, filed Sep. 13, 1996 (now abandoned), which is a continuation of U.S. application Ser. No. 08/497,682, filed Jun. 30, 1995 (now abandoned), which is a continuation of U.S. application Ser. No. 08/322,836, filed Oct. 13, 1994 (now abandoned), which is a continuation of U.S. application Ser. No. 08/164,653, filed Dec. 9, 1993 (now abandoned), which is a continuation of U.S. application Ser. No. 08/017,523, filed Feb. 16, 1993 (now abandoned).

FIELD OF THE INVENTION

The present invention relates to a toothbrush, and more particularly to a toothbrush capable of standing in a substantially upright position on a support surface.

BACKGROUND OF THE INVENTION

Toothbrushes are generally stored after use in an upright position to allow for the drainage of water. Since most toothbrushes have relatively narrow handles, they are not self-standing and are generally stored in a toothbrush holder. The holder generally consists of a support member having a plurality of holes or slots adapted to receive and support the toothbrush handle in an upright handle. These holders may be attached to a bathroom wall or medicine cabinet, or may be free standing for placement on a countertop.

U.S. Pat. No. 4,979,708 to Aoki describes a toothbrush holder for infants in the shape of an animated character. The holder also contains a suction cup for attaching the device to a flat surface.

U.S. Pat. No. 1,465,642 to Keene describes a freestanding toothbrush holder having a weighted base and a flexible bushing for receiving the end of the toothbrush handle opposite to the bristled head. U.S. Pat. No. 1,690,311 to Reich describes a similar holder having an upstanding cylindrical member mounted on a weighted base. The cylindrical member is large enough to receive the bristled head and serves as a toothbrush cover during travel. A resilient bushing is attached to the end of the toothbrush handle opposite to the bristled head. After use, this resilient bushing is inserted into the cylindrical member and the brush is stored on an upright position.

U.S. Pat. No. 1,899,242 to McNab describes a toothbrush holder containing a suction cup which is attached to the end of the handle opposite to the bristled head. After use, the suction cup is simply attached to the bathroom wall whereby the brush is stored in a substantially vertical position allowing for drainage. The suction cup contains a head which fits within an aperture formed in the end of the toothbrush. Alternatively, the suction cup is part of an elastomeric sleeve which fits over the toothbrush handle. Since the face of the suction cup is in a plane substantially parallel to the toothbrush handle, the cup must always be attached to a vertical surface in order for the brush to be held in a vertical position for draining. Thus, this holder is not suitable for use on a countertop.

Suction cups have been used to support other articles on a surface. U.S. Pat. No. 1,587,874 to Sticklin and U.S. Pat. No. 2,588,990 to Sanchez, both describe the use of suction cups on the bottom of dishes and other receptacles to prevent against accidental tipping. U.S. Pat. No. 2,712,709 to Pulrang describes a soap dish employing a suction cup as the mounting element.

U.S. Pat. No. 1,892,140 to Folger describes the use of a suction cup to support a collapsible tube, such as a toothpaste tube, in an upright position on a countertop. The collapsible tube is attached to the suction cup by inserting the cap, which covers the threaded end of the tube, into an aperture formed in the head of suction cup.

Rechargeable, motorized toothbrushes having a power supply, motor and control circuitry housed within the handle are known. These handles are generally larger than the handles found on conventional toothbrushes. Some of these handles have a flat bottom, which allows for the brush to stand on its end. However, the brush is intended to be stored in a separate housing containing the charging unit for the rechargeable batteries.

It would be desirable to have a toothbrush which is capable of being stored in a stable upright position without the use of an auxiliary holder. These brushes would be particularly useful in hotel bathrooms, where toothbrush holders are generally not provided. is

SUMMARY OF THE INVENTION

The present invention relates to a self-standing toothbrush having a bristled head connected to a top portion of the handle. The bottom portion of the handle forms a base, which is affixed to a means for enhancing the stability of the toothbrush when it is disposed in a substantially upright position relative to a support surface. Preferably, a cup-shaped member, such as a suction cup, is affixed to the base to enhance the stability of the toothbrush.

DETAILED DESCRIPTION OF THE PREFERRED EMBODIMENTS

Figure 1:
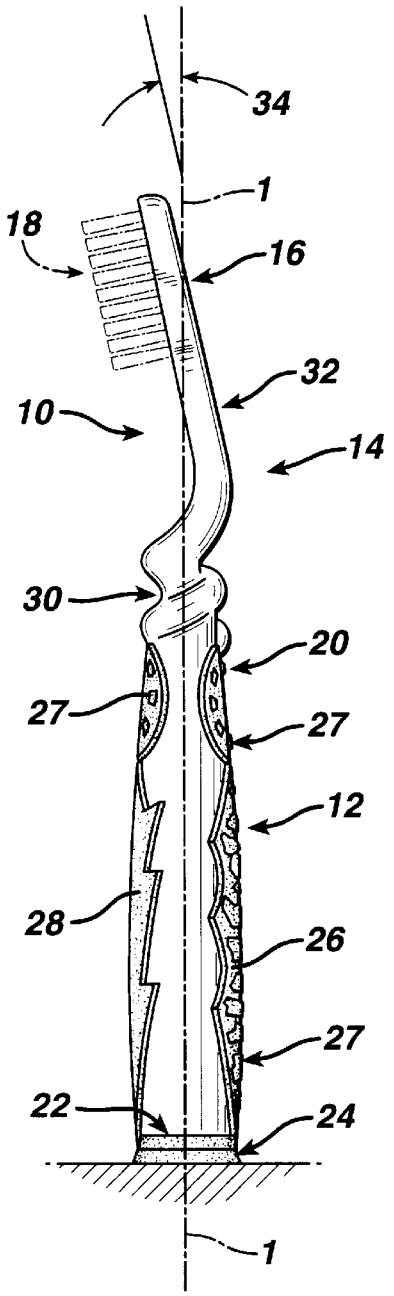
FIG. 1 is a side elevational view of the toothbrush in accordance with the present invention shown standing on a support surface.

Referring now to the drawings, where like reference numerals have been used to designate like or similar elements, there is shown in FIG. 1 a toothbrush of the present invention having the general designation 10. The toothbrush 10 is shown in a self-standing, substantially upright position relative to a support surface. Toothbrush 10 contains a handle having the general designation 12, a neck 14 and a head 16 with a plurality of bristles 18.

The handle 12 contains a top portion 20 which is connected via the neck 14 to the head 16. The handle 12 also contains a bottom portion 22 which forms a base. The handle 12 contains non-slip surfaces 26 and 28 disposed on opposed regions of the handle. The non-slip surfaces 26 and 28 contain a plurality of raised projections 27 which form non-slip regions on the handle 12. These non-slip regions are engaged by the user's thumb and fingers to facilitate better manipulation of the brush. The non-slip surfaces 26 and 28 as well as the projections 27 can be configured in virtually any manner on the handle 12.

The neck 14 of the toothbrush 10 contains a helical lower region 30 which is connected to the top portion 20 of the handle 12. The neck 14 also contains an upper region 32 which connects the helical lower region 30 to the head 16. The neck 14 is generally narrower than the handle 12. The upper region 32 and the head 16 both lie in substantially the same plane and are angled relative to a line 1—1, which is coincident with the longitudinal axis of the handle. This angle, identified by numeral 34 in FIG. 1, is within the range of about 9–15° and preferably about 12°. This angle gives the user improved access to the distal teeth.

Figure 2:
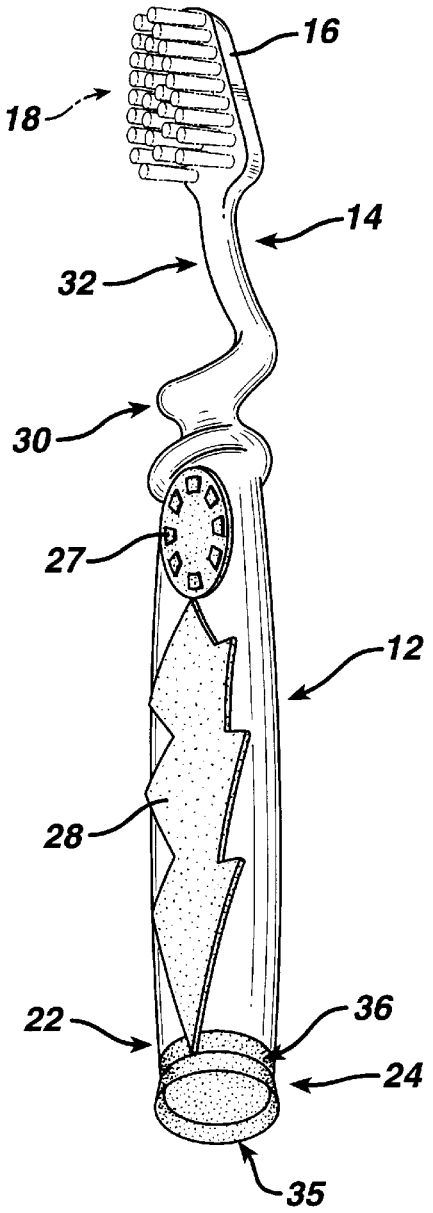
FIG. 2 is a bottom perspective view of the toothbrush of FIG. 1.
Figure 3:
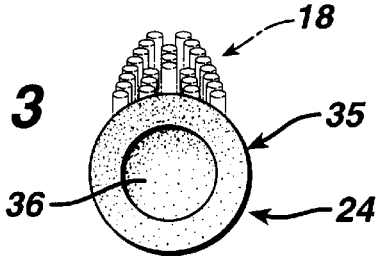
FIG. 3 is a bottom plan view of the toothbrush of FIG. 1.

Turning now to FIGS. 2–3, the means for enhancing the stability of the toothbrush 10 will be discussed in detail. Preferably, the means is a cup-shaped member 24, which is permanently affixed to the base 22 of the handle 12. The cup-shaped member 24 may take the form of a suction cup, although other cup-shaped members not capable of being vacuumed-attached to a surface may be employed. The cup-shaped member contains a head 36 which is attached to the base 22 of the handle 12. The cup-shaped member 24 also contains a rim 35 which engages a support surface when the toothbrush 10 is placed in the self-standing position. Although the wall of the cup-shaped member 24 in FIG. 2 extends outwardly from the head 36, other wall configurations, such as cylindrical wall, may be employed.

The rim 35 of the cup-shaped member 24 defines a cross-section having an area sufficient to stabilize the brush 10. As shown in FIG. 2, the base 22 of the handle 12 has a cross-sectional area which is less than the cross-section defined by the rim 35. The larger cross-section defined by the rim 35 enhances the stability of the brush 10. Further stability is achieved when the cup shaped member is a suction-cup, which is adhered to the support surface.

While the means for enhancing the stability of the brush 10 is shown in the form of a cup-shaped member 24, it should be understood it may take on other configurations so long as it enhances the stability of the toothbrush 10 while disposed in an upright position. For instance, the rim 35 of the cup-shaped member 24 may have a dimension, e.g., cross-sectional area or diameter, which is less than or equal to that of the handle 12.

When the cup-shaped member 24 is a suction cup, the brush 10 may be attached to a vertical surface, such as a bathroom mirror, so that the handle is horizontally disposed.

It is also advantageous in the present invention to position the upper region 32 of the neck 14 and the head 16 so that they are disposed within a right cylinder defined by the rim 35 of the cup-shaped member 24. If the upper region 32 of the neck 14 and the head 16 extend beyond this right cylinder, the toothbrush's center of gravity moves horizontally away from the handle's longitudinal axis and the brush may become unstable. As shown in FIG. 1, by terminating the helical lower region 30 of the neck 14 on the side of the toothbrush adjacent the non-slip surface 26, the upper region 32 and the head 16 can be disposed at an angle relative to the line 1—1, but still reside within the right cylinder defined by the rim of the cup-shaped member 24.

The handle 12, neck 14 and head 16 of the toothbrush 10 may be molded from a thermoplastic polymer, such as styrene-acrylonitrile, copolymers, polypropylene, cellulose acetate, cellulose acetate propionate, and polymethylmethacrylate. The handle 12, neck 14 and head 16 may be molded in conventional injection molding equipment.

The bristles 18 are inserted into the head 16 using conventional bristling equipment e.g., Boucherie, Zahoransky or Evans machines. The bristles 18 are fabricated from various plastic materials such as polyamides, polefins, polyesters or natural fibers, such as animal hair. Preferably, the bristles 18 are nylon.

The non-slip surfaces 26 and 28 may be fabricated from an elastomeric material such as neoprene, silicone rubber or RTV silicone, and preferably from a thermoplastic injection moldable rubber, such as SANTOPRENE® rubber from Monsanto Chemical Company. These parts may be fabricated, such as by molding, in a separate operation and then attached to the handle 12 with an adhesive or be formed as interlocking parts which are snapped into place. Alternatively, the non-slip surfaces 26 and 28 may be injection molded into a series of voids formed in the handle 12. This aspect will be disclosed in more detail in reference to FIGS. 4–7.

The cup-shaped member 24 may be fabricated from the materials used to form the handle 12, neck 14 and head 16, or from the above-described elastomeric materials used to fabricate the non-slip surfaces 26 and 28. When the cup-shaped member 24 is a suction cup, it is fabricated from an elastomeric material so that it has sufficient flexibility to be compressed and create a vacuum. The cup-shaped member 24 may be formed in a separate manufacturing step from the handle 12 and then glued or mechanically affixed to the base 22 of the handle 12. The cup-shaped member 24 may also be fabricated simultaneously with the molding step used to form the non-slip surfaces 26 and 28 described below.

Commercially available, fully automated processes for forming toothbrush handles from separate or different colored materials may be used to fabricate the toothbrush of the present invention. One such process is described in an article entitled "Zahoransky's Fully Automated Two-Color Mold", Brossa Press, 1989. In the first step of the process, the plastic material which forms the bulk of the toothbrush 10, i.e., the handle 12, neck 14 and head 16, is injected into the cavity of the mold. The resulting structure is a partially formed toothbrush having a handle with a series of void spaces. The partially formed toothbrush is then moved into a second cavity within the same mold where a second or different colored material is injection into the void spaces to complete the toothbrush handle. The second mold cavity is contoured so that the non-slip surfaces 26 and 28 and the cup-shaped member 24 are formed during the second molding step. Generally the first material forming the bulk of the toothbrush is polypropylene, while the second material is SANTOPRENE® rubber. The same material, but colored with two different pigments, may also be used in the process to from a multi-colored toothbrush.

Figure 4:
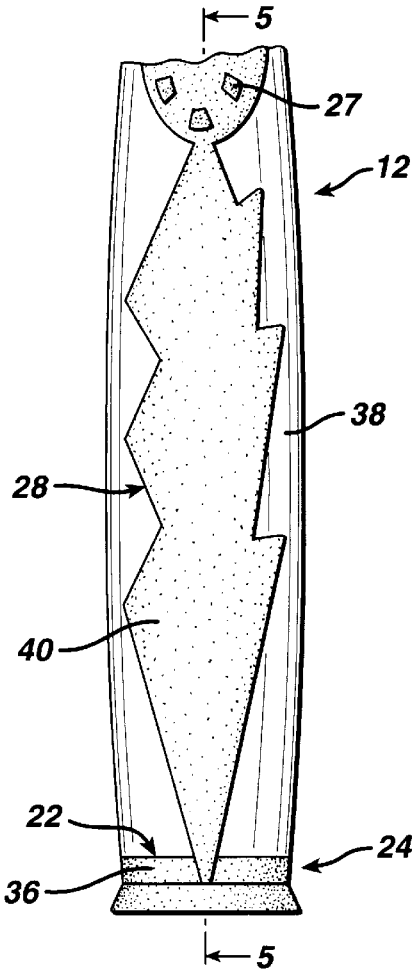
FIG. 4 is an enlarged fragmentary front view of the handle portion of the toothbrush of FIG. 1.
Figure 5:
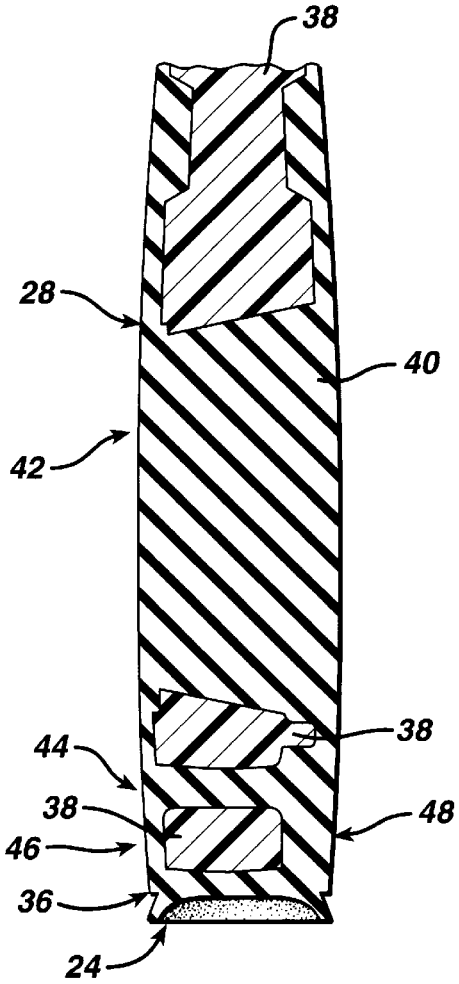
FIG. 5 is a cross-sectional view of the handle taken along line 5—5 of FIG. 4.
Figure 6:
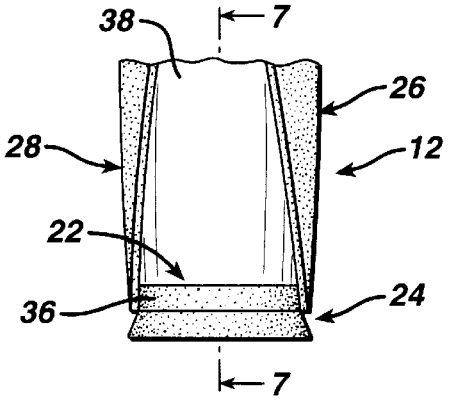
FIG. 6 is an enlarged fragmentary side view of the handle portion of the toothbrush of FIG. 1.
Figure 7:
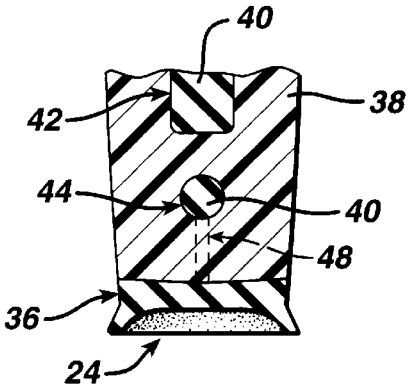
FIG. 7 is a cross-sectional view of the handle taken along line 7—7 of FIG. 6.

Turning now to FIGS. 4–7, the handle 12 formed from two different materials will be described in detail. As shown in FIGS. 4 and 5, the bulk of the handle 12 is fabricated from a polypropylene material 38. The non-slip regions 26 and 28 and the cup-shaped member 24 are fabricated from a thermoplastic rubber 40. As shown in FIG. 5, the handle 12 contains a series of cavities 42 and 44 which extend through the handle 12 and are filled with the thermoplastic rubber 40. During the molding process, molten thermoplastic rubber also flows toward the base portion 22 through a pair of slots 46 and 48. The molten thermoplastic rubber flowing through the slots 46 and 48 fills the portion of the mold cavity contoured to form the cup-shaped member 24.

EXAMPLE

In order to demonstrate the enhanced stability which is achieved with the toothbrush of the present invention, a series of toothbrushes were tested for their stability when standing in an upright position on a flat, horizontally disposed support surface.

Test 1

The toothbrush in FIG. 1 was fabricated using a process similar to that described in the article entitled "Zahoransky's Fully Automated Two-Color Mold". The bulk of the brush was fabricated from polypropylene, while the non-slip surfaces 26 and 28 and the cup-shaped member 24 were fabricated from SANTOPRENE® thermoplastic rubber. The diameter of the rim 35 of the cup-shaped member 24 was approximately 1.6 cm and the brush length was approximately 15.8 cm. The brush was then placed on end in a self-standing position. No downward force applied to the brush, so there was no suction created between the cup-shaped member 24 and the support surface. A horizontal force was applied to the tip of the toothbrush head and the brush tipped over after having been deflected approximately 8°, relative to vertical.

Test 2

Test 1 was repeated, except that a downward force was applied to the brush so as to create a suction between the cup-shaped member 24 and the support surface. When the horizontal force was applied to the brush in this configuration, the suction broke after about 4° of deflection and the brush tipped over after having been deflected about 8°, both relative to vertical. The force required to break the suction between the cup-shaped member and the support surface was significantly greater than the force used to tip the brush over in Test 1.

Test 3

Test 1 was repeated, except that the cup-shaped member 24 was removed from the brush depicted in FIG. 1 so that the flat polypropylene base 22 was left exposed. The flat base 22 was then placed on the support surface so that the brush was disposed in a self-standing position. When the horizontal force was applied, the brush tipped over after having been deflected about 3 to 5° relative to vertical.

The above results demonstrate that the cup-shaped member substantially enhances the stability of the toothbrush when it is disposed in a substantially upright position relative to the support surface. The toothbrush containing such a member can be deflected to approximately 8° relative to vertical, whereas the brush having only a flat base tipped over after being deflected about 3 to 5° relative to vertical.

The foregoing description and drawings are intended to be illustrative of the present invention. Various changes and modifications can be made to the above-described embodiments without departing from the spirit and scope of the present invention.

What is claimed:

1. A toothbrush, comprising:

a head;

a straight neck aligned with the head;

a plurality of bristles disposed on said head;

an elongated handle having a longitudinal axis passing through said handle and aligned centrally along a length of said handle, said handle having a first side and a second side that is positioned opposite said first side, said first and second sides being aligned generally along said longitudinal axis;

said handle having a top portion connected to the straight neck, wherein said top portion comprises a helical shape that begins on said first side of said handle and ends at a transition point on said second side of said handle, said straight neck being connected to said helical shape at said transition point; and wherein said straight neck crosses said longitudinal axis and is disposed at an angle with respect to said longitudinal axis.

2. A toothbrush according to claim 1, wherein said handle has a bottom portion forming a base, and wherein a cup-shaped member is affixed to said base.

3. A toothbrush according to claim 2, wherein said cup-shaped member has a rim for contacting a support surface.

4. A toothbrush according to claim 33, wherein an upper region of the neck and the head are disposed within a right cylinder defined by the rim of the cup-shaped member.

5. A toothbrush according to claim 3, wherein the rim has a cross-section dimensioned to enhance stability of the toothbrush while the toothbrush is disposed in a substantially upright position relative to the support surface.

6. A toothbrush according to claim 5, wherein the cross-section of the rim is greater than a cross-sectional area of the base.

7. A toothbrush according to claim 6, wherein each of said base and said rim have a substantially circular cross-section and the base has a diameter that is less than a diameter of the rim.

8. A toothbrush according to claim 2, wherein said cup-shaped member is a suction cup.

9. A toothbrush according to claim 8, wherein said suction cup comprises an elastomeric material.

10. A toothbrush according to claim 1, wherein the angle is within the range of about 9 to 15 degrees.

11. A toothbrush according to claim 1, further comprising a non-slip surface disposed on the handle.

* * * * *